US010618099B2

(12) United States Patent
Nakai et al.

(10) Patent No.: US 10,618,099 B2
(45) Date of Patent: Apr. 14, 2020

(54) SIZING DIE FOR DENSIFYING SURFACE OF SINTERED BODY, PRODUCTION METHOD USING SAME, AND PRODUCT OBTAINED THEREFROM

(71) Applicant: Diamet Corporation, Niigata-shi (JP)

(72) Inventors: Takashi Nakai, Niigata (JP); Kinya Kawase, Niigata (JP)

(73) Assignee: Diamet Corporation, Niigata-shi (JP)

( * ) Notice: Subject to any disclaimer, the term of this patent is extended or adjusted under 35 U.S.C. 154(b) by 357 days.

(21) Appl. No.: 15/536,956

(22) PCT Filed: Mar. 11, 2016

(86) PCT No.: PCT/JP2016/057744
§ 371 (c)(1),
(2) Date: Jun. 16, 2017

(87) PCT Pub. No.: WO2016/158316
PCT Pub. Date: Oct. 6, 2016

(65) Prior Publication Data

US 2017/0341130 A1 Nov. 30, 2017

(30) Foreign Application Priority Data

Mar. 31, 2015 (JP) ..... 2015-072640

(51) Int. Cl.
*B21J 5/06* (2006.01)
*B21J 13/02* (2006.01)
(Continued)

(52) U.S. Cl.
CPC ..... *B21J 5/06* (2013.01); *B21C 37/30* (2013.01); *B21J 5/002* (2013.01); *B21J 5/02* (2013.01);
(Continued)

(58) Field of Classification Search
None
See application file for complete search history.

(56) References Cited

U.S. PATENT DOCUMENTS 2,542,912 A * 2/1951 Ensign ..... B22F 3/16 72/349
3,848,453 A * 11/1974 Hardt ..... B21C 3/00 72/467
(Continued)

FOREIGN PATENT DOCUMENTS

DE 10 2010 009 800 B 6/2011
DE 102010009800 B3 * 6/2011 ..... B22F 3/164
(Continued)

OTHER PUBLICATIONS

Extended European Search Report dated Nov. 7, 2018 for the corresponding European Patent Application No. 16772200.8.
(Continued)

*Primary Examiner* — Teresa M Ekiert
*Assistant Examiner* — Jared O Brown
(74) *Attorney, Agent, or Firm* — Leason Ellis LLP

(57) ABSTRACT

In a die for compressing and sizing a sintered body at straight portions, upper taper portions are provided on a die upper portion and a core rod upper portion, and the straight portions are provided at a die lower portion and a core rod lower portion. The die upper portion and the core rod upper portion have Young's moduli higher than the die lower portion and the core rod lower portion. The die upper portion and the core rod upper portion are made of materials having Young's moduli that are at least 50 GPa higher than that of the sintered body. The sintered body can be densified with a smaller ironing margin. Since the sintered body is ironed without being compressed, by the upper taper portions and the core rod upper portion having high Young's moduli, the
(Continued)

die is prevented from breaking and being abraded due to ironing.

16 Claims, 8 Drawing Sheets

(51) Int. Cl.

| | |
|---|---|
| ***B21J 5/00*** | (2006.01) |
| ***B21C 37/30*** | (2006.01) |
| ***B22F 3/24*** | (2006.01) |
| ***B21J 5/02*** | (2006.01) |
| ***B22F 3/16*** | (2006.01) |
| ***B21K 1/30*** | (2006.01) |

(52) U.S. Cl.
CPC ..... *B21J 13/02* (2013.01); *B21J 13/025* (2013.01); *B21K 1/30* (2013.01); *B22F 3/164* (2013.01); *B22F 3/24* (2013.01); *B22F 2998/10* (2013.01)

(56) References Cited

U.S. PATENT DOCUMENTS

| | | | | |
|---|---|---|---|---|
| 4,111,031 | A | 9/1978 | Vennemeyer et al. | |
| 5,019,114 | A * | 5/1991 | Gronbaek | B21C 3/02 249/135 |
| 6,038,906 | A * | 3/2000 | Hartung | B21B 27/02 72/241.8 |
| 6,168,754 | B1 * | 1/2001 | Woolf | B22F 3/03 29/893.34 |
| 2005/0084557 | A1 * | 4/2005 | Fueller | B21D 22/02 425/170 |
| 2011/0317949 | A1 | 12/2011 | Ito et al. | |
| 2015/0314359 | A1 * | 11/2015 | LeFevere | G01N 3/56 72/376 |

FOREIGN PATENT DOCUMENTS

| | | | | |
|---|---|---|---|---|
| JP | 05-85995 | A | | 4/1993 |
| JP | 2004-010906 | A | | 1/2004 |
| JP | 2007-031814 | A | | 2/2007 |
| JP | 2010-229433 | A | | 10/2010 |
| JP | 2011-47005 | A | | 3/2011 |
| JP | 2011047001 | A | * | 3/2011 |
| KR | 20130096478 | A | | 8/2013 |
| WO | WO-2011/107239 | A | | 9/2011 |

OTHER PUBLICATIONS

International Search Report dated Jun. 7, 2016 for the corresponding PCT Application No. PCT/JP2016/057744.

* cited by examiner

SIZING DIE FOR DENSIFYING SURFACE OF SINTERED BODY, PRODUCTION METHOD USING SAME, AND PRODUCT OBTAINED THEREFROM

CROSS-REFERENCE TO RELATED PATENT APPLICATIONS

This application is a U.S. National Phase Application under 35 U.S.C. § 371 of International Patent Application No. PCT/JP2016/057744, filed Mar. 11, 2016, and claims the benefit of Japanese Patent Application No. 2015-072640, filed Mar. 31, 2015, all of which are incorporated by reference herein in their entireties. The International Application was published in Japanese on Oct. 6, 2016 as International Publication No. WO/2016/158316 under PCT Article 21(2).

FIELD OF THE INVENTION

The present invention relates to a sizing die for densifying sintered body surface; a production method using the same; and a product obtained through such production method.

BACKGROUND OF THE INVENTION

Powder metallurgy is known to be performed as follows. That is, a material powder mainly made from a metal is compressed to form a compact, followed by heating such compact so as to sinter the same, thus obtaining a sintered body having a given shape. As for such sintered body which is obtained by compacting a material powder at first and then sintering the same, a high degree of freedom in product shape is ensured in a way such that products having relatively complex shapes can be manufactured at low cost (e.g. Patent document 1).

Particularly, as for parts such as various gears that are subjected to stresses when coming into contact with chains and other gears at the point of use, surface densification has been performed by reducing voids. In this way, the intensity of abrasion at points of contact can be lowered, and the strengths at such points of contact can be improved.

Meanwhile, in order to improve the precision in size that has worsened due to deformation at the time of performing sintering, there has been performed sizing in which recompression is performed by a press after performing sintering.

Examples of conventional methods for performing densification are as follows. That is, a high pressure may be applied when performing sizing; a sintered body that has softened through preliminary sintering may be recompressed; and there have also been attempted rolling, shot peening, cold forging and hot forging.

However, there has been a problem that a die will break easily if an excessively high pressure is applied at the time of performing sizing. Also, recompression after preliminary sintering, rolling, shot peening, forging and the like require more steps, which has led to a problem that cost will increase.

Here, as a surface densification method that is performed at the time of performing sizing and does not employ a high pressure, attempts that have been made include installing stepwise portions, protrusions and tapered portions in a sizing die, leaving a large ironing margin and performing coining (Patent documents 2, 3, 4 and 5).

PRIOR ART DOCUMENT

Patent Document

Patent document 1: JP-A-2007-31814
Patent document 2: JP-A-2010-229433
Patent document 3: Specification of U.S. Pat. No. 2,542,912
Patent document 4: JP-A-2004-10906
Patent document 5: JP-A-Hei-5-85995

Problem to be Solved by the Invention

As are the cases with the above patent documents 2, 3, 4 and 5, the method of installing stepwise portions, protrusions and tapered portions in a die has caused a problem that such stepwise portions, protrusions and tapered portions are more susceptible to abrasion. And, the method of leaving a large ironing margin or performing coining has caused a problem that a sized sintered body will exhibit a significant level of burrs.

Further, there have been a problem that surface densification will become difficult when the Young's modulus of a sintered body and the Young's modulus of a die are at the similar level; and a problem that a higher Young's modulus of the die will cause the die itself to break easily at the time of performing compression.

The present invention is to thus solve the aforementioned problems. It is an object of the present invention to provide a sizing die for densifying sintered body surface that is capable of preventing the die from being abraded and breaking, and a sintered body from forming burrs after being sized, when sizing the sintered body and densifying the surface thereof at the same time; and a production method using such sizing die.

SUMMARY OF THE INVENTION

Means to Solve the Problem

According to the invention as set forth in claim 1, provided is a sizing die for densifying sintered body surface. The sizing die comprises:

a die member having a taper portion provided on an upper portion of the die member; and a straight portion provided on a lower portion of the die member, the straight portion allowing a sintered body obtained by sintering a compact of a metal powder to be compressed and sized, wherein the upper portion of the die member is made of a material having a Young's modulus that is higher than the Young's modulus of a material of the lower portion of the die member, and is at least 50 GPa higher than the Young's modulus of the sintered body.

According to the invention as set forth in claim 2, the die member includes a die.

According to the invention as set forth in claim 3, the die member includes a core rod.

According to the invention as set forth in claim 4, at the lower portion of the die member, a lower taper portion is provided between the straight portion and the taper portion of the upper portion of the die member.

According to the invention as set forth in claim 5, at a lower portion of the die, a lower taper portion is provided between the straight portion and a taper portion of an upper portion of the die.

According to the invention as set forth in claim 6, at a lower portion of the cord rod, a lower taper portion is provided between the straight portion and a taper portion of an upper portion of the core rod.

According to the invention as set forth in claim 7, the upper portion of the die member is formed into a size with which the sintered body does not come into contact when ejected.

According to the invention as set forth in claim 8, an upper portion of the die is formed into a size larger than an expanded size of the sintered that has expanded due to an outer diameter spring-back effect when ejected.

According to the invention as set forth in claim 9, an upper portion of the core rod is formed into a size smaller than a shrunk size of the sintered body that has shrunk due to an inner diameter spring-back effect when ejected.

According to the invention as set forth in claim 10, the upper portion of the die member is made of a material having a Young's modulus of not smaller than 300 GPa, and the lower portion of the die member is made of a material having a Young's modulus smaller than 300 GPa.

According to the invention as set forth in claim 11, the upper portion of the die member is made of a cemented carbide, and the lower portion of the die member is made of a ferrous tool steel.

According to the invention as set forth in claim 12, an ironing margin of the sintered body is not larger than 0.1 mm based on the upper portion of the die member.

According to the invention as set forth in claim 13, an approach angle of the taper portion of the upper portion of the die member is smaller than 10°.

According to the invention as set forth in claim 14, provided is a production method capable of sizing the sintered body and densifying a surface thereof at the same time using the sizing die as set forth in any one of claims 1 to 6.

According to the invention as set forth in claim 15, the sintered body is sized and has the surface thereof densified at the same time in a manner such that the sintered body is sized by the taper portion when inserted from the taper portion of the upper portion of the die member toward the straight portion of the lower portion of the die member, and is vertically compressed by punches at the straight portion of the lower portion of the die member.

According to the invention as set forth in claim 16, the sintered body has a Young's modulus of not lower than 200 GPa before being sized.

According to the invention as set forth in claim 17, the sintered body is not further processed after being sized.

According to the invention as set forth in claim 18, provided is a product produced by the production method as set forth in any one of claims 14 to 16.

Effects of the Invention

According to the aforementioned configuration, when sizing the sintered body and densifying the surface thereof at the same time, the die can be prevented from being abraded and breaking, and the sintered body can be prevented from forming burrs after being sized.

DETAILED DESCRIPTION OF THE INVENTION

Figure 1:
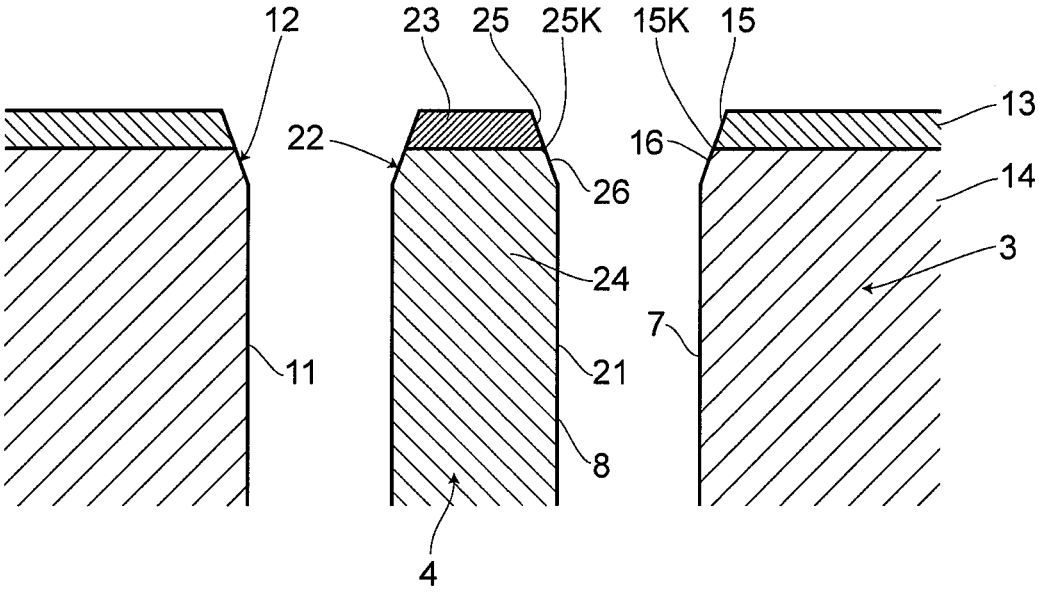
FIG. 1 is a cross-sectional view of a die described in a first embodiment of the invention.

Preferable embodiments of the present invention are described in detail with reference to the accompanying drawings. However, the embodiments described hereunder shall not limit the contents of the invention that are described in the claims. Further, not all the elements described hereunder are necessarily the essential elements of the invention. In each embodiment, there are described a sizing die for densifying sintered body surface; a production method using the same; and a product obtained using the same. By employing a sizing die for densifying sintered body surface that is different from its conventional counterparts, there can be acquired a novel sizing die for densifying sintered body surface; a production method using the same; and a product obtained using the same.

First Embodiment

A first embodiment of the invention is described in detail hereunder with reference to the accompanying drawings. Described is an example of a method for manufacturing products such as shaft bearings and various types of gears. A product here is a gear which is produced as follows. That is, a green compact is at first formed by performing pressure molding on a raw material powder such as a Fe-based powder, followed by sintering such green compact so as to obtain a sintered body 1. The sintered body 1 is then sized (corrected) to obtain the gear that is thus made of such sintered body 1. Particularly, the sintered body 1 may have a Young's modulus of not lower than 200 GPa before being sized.

FIG. 1 to FIG. 5 show a sizing die 2. As shown in these drawings, the sizing die 2 used to size the sintered body 1 includes a die 3, a core rod 4, a lower punch 5 and an upper punch 6; and a vertical direction of the sizing die 2 serves as an axial direction (vertical axial direction for pressing) thereof. The die 3 is substantially formed into a cylindrical shape, and core rod 4 that is substantially formed into the shape of a pole is located inside the die 3 in a coaxial manner. Further, the die 3 has an inner circumferential surface 7 corresponding to the shape of the outer circumferential surface of the sintered body 1; and the core rod 4 has an outer circumferential surface 8 corresponding to the shape of the inner circumferential surface of the sintered body 1. The lower punch 5 is substantially formed into a cylindrical shape, and is fitted between the die 3 and the core rod 4 in a way such that the lower punch 5 is capable of freely moving in the vertical direction from below. The upper punch 6 is substantially formed into a cylindrical shape, and is detachably fitted between the die 3 and the core rod 4 in a way such that the upper punch 6 is capable of freely moving in the vertical direction from above. Here, the die 3 and the core rod 4 compose a die member.

The cross-sectional shape of the die 3 is such that there is formed a substantially even die straight portion 11, and that a die taper portion 12 expanding upward is provided on the upper region of the die straight portion 11. Further, with regard to the die 3, a die upper portion 13 as the upper portion of the die 3 is made of a material that is different from that of a die lower portion 14 as the lower portion of the die 3.

Similarly, the cross-sectional shape of the core rod 4 is such that there is formed a substantially even core straight portion 21, and that a core taper portion 22 diminishing upward is provided on the upper region of the core straight portion 21. Further, with regard to the core rod 4, a core rod upper portion 23 as the upper portion of the core rod 4 is made of a material that is different from that of a core rod lower portion 24 as the lower portion of the core rod 4.

In this embodiment, the die 3 is divided into the die upper portion 13 and the die lower portion 14 midway through the die taper portion 12 in the height direction. There, the die 3 is divided into the die upper portion 13 and the die lower portion 14 in a planar direction orthogonal to the axial direction of the die 3, and the die 3 integrally includes these die upper portion 13 and die lower portion 14. Here, the die upper portion 13 has a substantially even thickness. Further, the die taper portion 12 is composed of a die upper taper portion 15 of the die upper portion 13; and a die lower taper portion 16 of the die lower portion 14 that is continuous with the die upper taper portion 15. That is, the die lower taper portion 16 as an intermediate portion is provided between the die upper taper portion 15 and the die straight portion 11, and an inner diameter NS of the die straight portion 11 is smaller than the smallest diameter NK of a lower end 15K of the die upper taper portion 15.

Further, although the die upper portion 13 and the die lower portion 14 are provided in an integrated fashion, the die upper portion 13 can be detachably attached to the die lower portion 14 through a fixation member (not shown) such as a screw. In such case, the die upper portion 13 can replaced easily.

Similarly, the core rod 4 is divided into the core rod upper portion 23 and the core rod lower portion 24 midway through the core taper portion 22 in the height direction. There, the core rod 4 is divided into the core rod upper portion 23 and the core rod lower portion 24 in a planar direction orthogonal to the axial direction of the core rod 4, and the core rod 4 integrally includes these core rod upper portion 23 and core rod lower portion 24. Here, the core rod upper portion 23 has a substantially even thickness. Further, the core taper portion 22 is composed of a core upper taper portion 25 of the core rod upper portion 23; and a core lower taper portion 26 of the core rod lower portion 24 that is continuous with the core upper taper portion 25. That is, the core lower taper portion 26 as an intermediate portion is provided between the core upper taper portion 25 and the core straight portion 21, and an outer diameter GS of the core straight portion 21 is larger than the largest diameter GK of a lower end 25K of the core upper taper portion 25.

Further, although the core rod upper portion 23 and the core rod lower portion 24 are provided in an integrated fashion, the core rod upper portion 23 can be detachably attached to the core rod lower portion 24 through a fixation member (not shown) such as a screw. In such case, the core rod upper portion 23 can replaced easily.

The Young's moduli of the materials of the die upper portion 13 and the core rod upper portion 23 are higher than those of the materials of the die lower portion 14 and the core rod lower portion 24. It is preferred that the die upper portion 13 and the core rod upper portion 23 be made of materials having Young's moduli that are at least 50 GPa higher than that of the sintered body 1 that has not yet been sized. Here, the die lower portion 14 and the core rod lower portion 24 are tougher than the die upper portion 13 and the core rod upper portion 23. The unsized sintered body 1 having a Young's modulus of not lower than 200 GPa can then be sized. Moreover, the die lower portion 14 and the core rod lower portion 24 are made of materials having Young's moduli higher than that of the sintered body 1, and exhibit 0.2% proof stresses higher than that of the sintered body 1. Here, the die upper portion 13 and the core rod upper portion 23 may be made of an identical material; and the die lower portion 14 and the core rod lower portion 24 may be made of an identical material as well.

Further, the die upper portion 13 and the core rod upper portion 23 are made of materials having Young's moduli of not smaller than 300 GPa; and the die lower portion 14 and the core rod lower portion 24 are made of materials having Young's moduli of smaller than 300 GPa. Furthermore, the die upper portion 13 and the core rod upper portion 23 are made of cemented carbides; and the die lower portion 14 and the core rod lower portion 24 are made of ferrous tool steels.

Under JIS B4053, examples of the cemented carbides for use in the die upper portion 13 and the core rod upper portion 23 include V10, V20, V30, V40, V50, HW-P01, HW-P10, HW-P20, HW-P30, HW-P40, HW-P50, HW-M10, HW-M20, HW-M30, HW-M40, HW-K01, HW-K10, HW-K20, HW-K30, HW-K40, HT-P01, HT-P10, HT-P20, HT-P30, HT-P40, HT-P50, HT-M10, HT-M20, HT-M30, HT-M40, HT-K01, HT-K10, HT-K20, HT-K30, HT-K40, HF-P01, HF-P10, HF-P20, HF-P30, HF-P40, HF-P50, HF-M10, HF-M20, HF-M30, HF-M40, HF-K01, HF-K10, HF-K20, HF-K30, HF-K40, HC-P01, HC-P10, HC-P20, HC-P30, HC-P40, HC-P50, HC-M10, HC-M20, HC-M30, HC-M40, HC-K01, HC-K10, HC-K20, HC-K30 and HC-K40. The Young's moduli of these cemented carbides are about 400 to 650 GPa.

Further, under CIS 019D (by Japan Cemented Carbide Tool Manufacturers Association), examples of the above-mentioned cemented carbides include VF-10, VF-20, VF-30, VF-40, VM-10, VM-20, VM-30, VM-40, VM-50, VM-60, VC-40, VC-50, VC-60, VC-70, VC-80, VU-40, VU-50, VU-60, VU-70, VU-80, RC-50, RC-60, RC-70, RC-80, RU-50, RU-60, RU-70, RU-80, NF-20, NF-30, NF-40, NM-40, NM-50, NM-60, NM-70, NC-60, NC-70 and NC-80. The Young's moduli of these cemented carbides are about 440 to 650 GPa.

Examples of the ferrous tool steels for use in the die lower portion 14 and the core rod lower portion 24 are as follows. That is, there may be used alloy tool steels (JIS G4404) such as SKS3, SKS31, SKS93, SKS94, SKS95, SKD1, SKD2, SKD4, SKD5, SKD6, SKD7, SKD8, SKD10, SKD11, SKD12, SKD61, SKD62, SKT3, SKT4 and SKT6; high-speed tool steels (JIS G4403) such as SKH2, SKH3, SKH4, SKH10, SKH40, SKH50, SKH51, SKH52, SKH53, SKH54, SKH55, SKH56, SKH57, SKH58 and SKH59; and even carbon tool stools (JIS G4401). The Young's moduli of these tool steels are about 200 to 230 GPa.

Figure 2B:
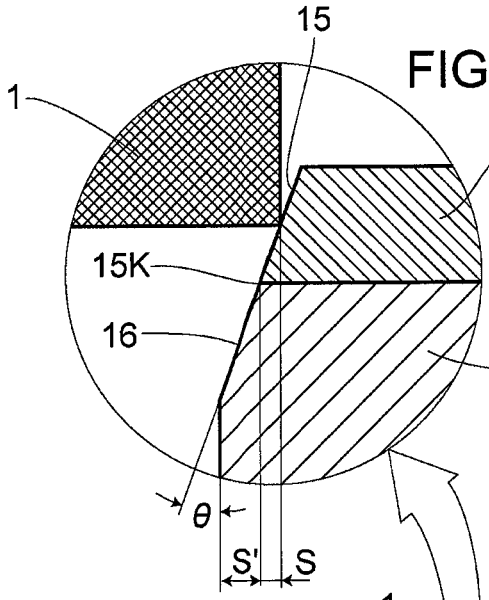
FIGS. 2A and 2B are cross-sectional views of the die of the first embodiment, in which a sintered body has not yet been ironed.
Figure 2A:
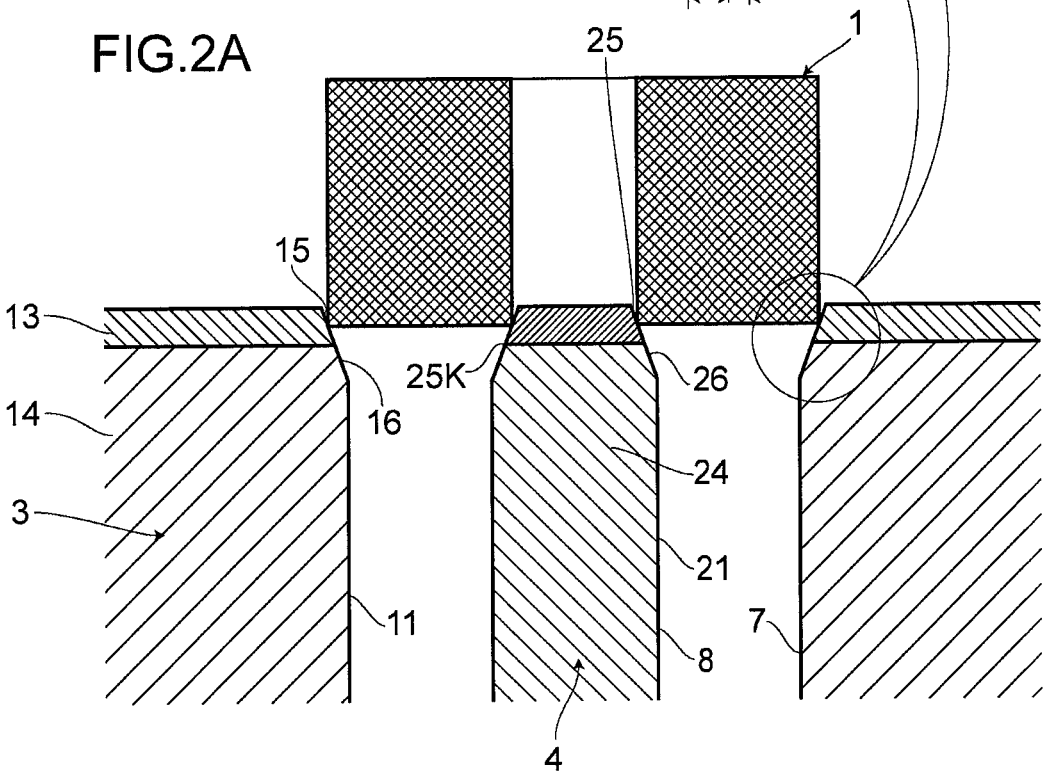
Figure 3:
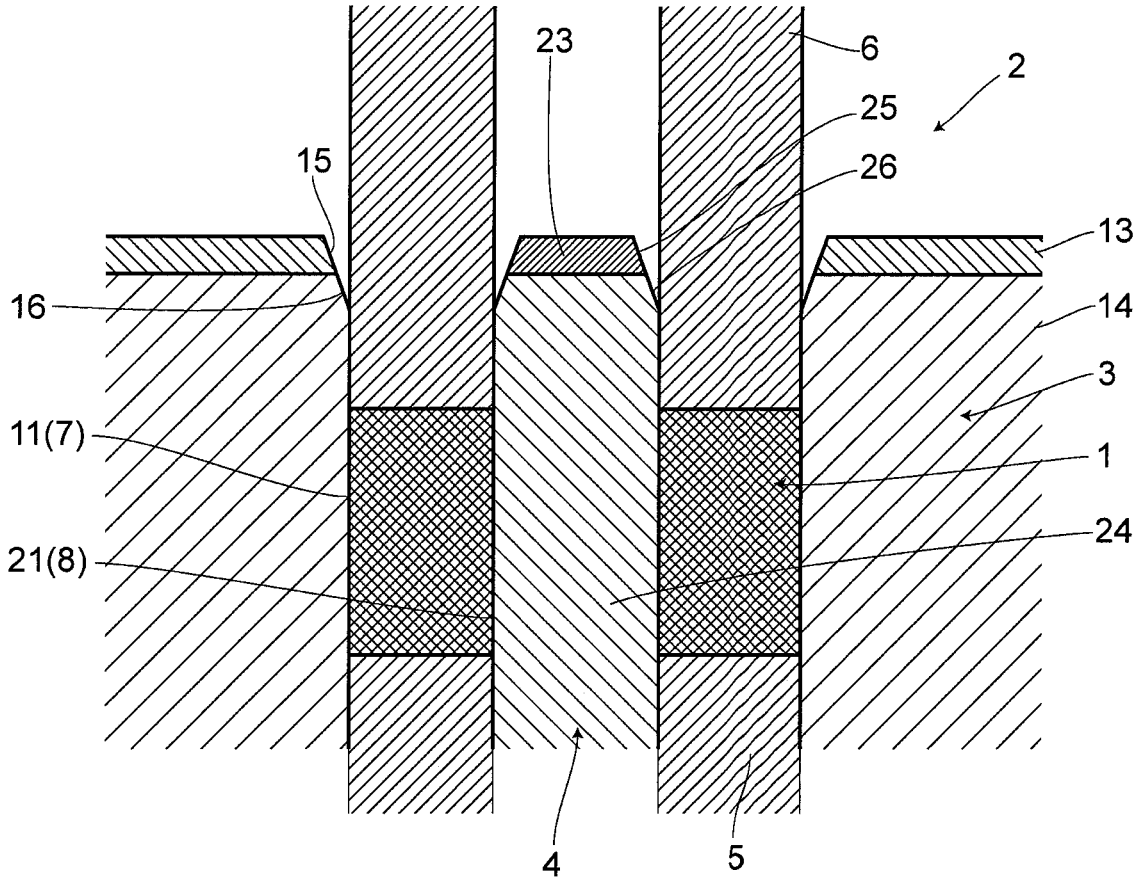
FIG. 3 is a cross-sectional view of the die of the first embodiment, in which the sintered body is being compressed at straight portions.
Figure 4:
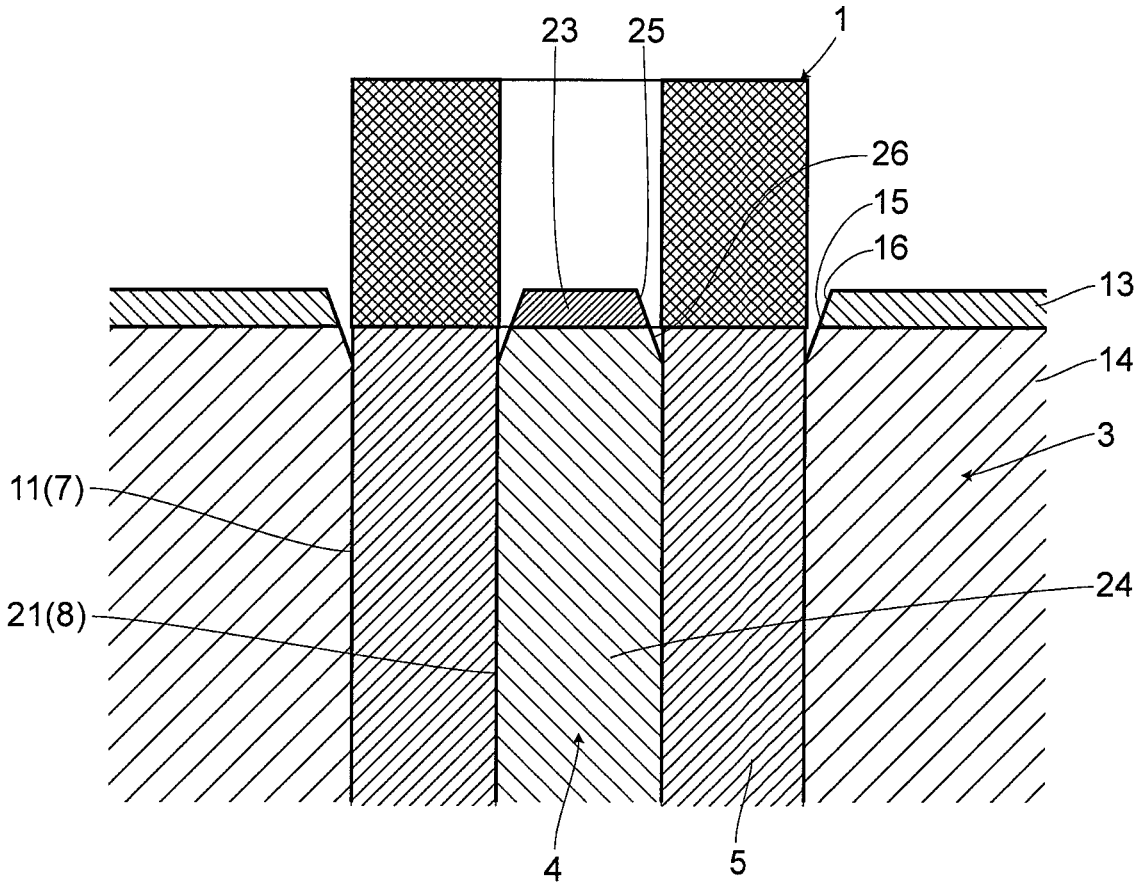
FIG. 4 is a cross-sectional view of the die of the first embodiment, in which the sintered body has been ejected.
Figure 5:
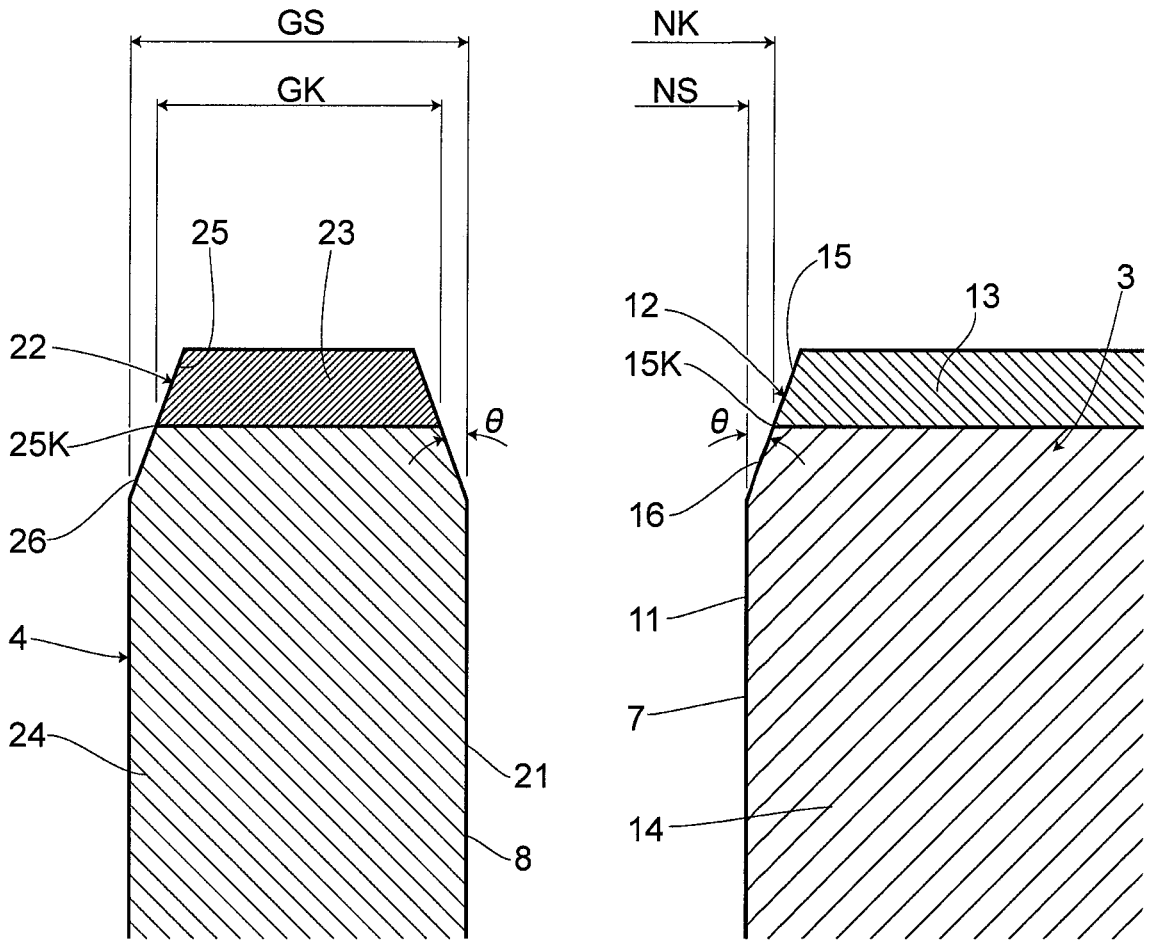
FIG. 5 is another cross-sectional view of the die of the first embodiment.

As shown in FIGS. 2A and 2B, in order to prevent burrs from occurring on the sintered body 1, an ironing margin S of the sintered body 1 at the die upper portion 13 and the core rod upper portion 23 is not smaller than 0.01 mm, and not larger than 0.1 mm. Particularly, the ironing margin S at the die 3 is one-half of the difference between the outer diameter dimension of the sintered body 1 and the inner diameter dimension of the upper taper portion 15 at the lower end 15K. Further, the ironing margin S at the core rod 4 is one-half of the difference between the inner diameter dimension of the sintered body 1 and the outer diameter dimension of the upper taper portion 25 at the lower end 25K.

Moreover, an approach angle θ of the upper taper portions 15, 25 is not smaller than 0.0001°, but smaller than 10°. By employing an approach angle θ smaller than 10° in such manner, there can be restricted the occurrence of the burrs of the sintered body 1 after performing sizing, and the upper taper portions 15, 25 can be restricted from being abraded. Further, the smaller the approach angle θ is, the longer the upper taper portions 15, 25 will become in a way such that cost will rise, and that installation will become difficult. Therefore, it is preferred that the approach angle θ be not smaller than 0.0001°. Here, in the accompanying drawings, the approach angle θ is illustrated as 20° for the sake of ease in comprehension.

A sizing method is described hereunder. In the beginning, as shown in FIG. 2A, the sintered body 1 is to be positioned to the upper taper portions 15, 25, followed by pushing the sintered body 1 downward along the straight portions 11, 21.

At that time, the sintered body 1 will travel along the upper taper portions 15, 25 having Young's moduli higher than that of the sintered body 1. As a result, the sintered body 1 will be ironed and sized in a way such that the outer and inner surfaces thereof will be densified. Next, at the straight portions 11, 21, the sintered body 1 will be compressed by the upper and lower punches 6, 5 so that the surface of the sintered body 1 will be densified to an extent that almost all surface voids will disappear.

That is, at the upper taper portions 15, 25 having higher Young's moduli, the sintered body 1 is only ironed, but not compressed. There, ironing allows the sintered body 1 to be plastically deformed while being squeezed in the radial direction, and even be plastically deformed in the vertical direction. In this way, although the surface of the sintered body 1 will be densified, surface voids that are elongated in the vertical direction will remain. Later, the sintered body 1 will be compressed by the upper and lower punches 6, 5 at the straight portions 11, 21 having Young's moduli lower than those of the upper taper portions 15, 25, thereby allowing the surface of the sintered body 1 to be densified, and the voids to disappear. Although a compression pressure varies based on the materials of the sintered body and die, it is preferred that such compression pressure be about 1 to 14 t/cm$^2$ when the sintered body is a ferrous sintered body, and when a lower die is made of a ferrous tool steel. When the compression pressure is lower than 1 t/cm$^2$, densification may not take place sufficiently. When the compression pressure is greater than 14 t/cm$^2$, the die may break even when it is made of a ferrous tool steel, and the sintered body will exhibit a more significant burr(s). It is more preferred that such compression pressure be about 4 to 10 t/cm$^2$.

Further, after the upper punch 6 has receded upward, the lower punch 5 will rise to eject the sintered body 1. At that time, the outer diameter of the sintered body 1 that has come out of the straight portions 11, 21 will expand, and the inner diameter thereof will shrink, due to a spring-back effect. However, as described later, since the sintered body 1 will not come into contact with the upper taper portions 15, 25, the upper taper portions 15, 25 having higher Young's moduli can be prevented from being abraded and damaged.

The reason that the upper taper portions 15, 25 are provided as above is because stepwise portions and protrusions tend to be abraded intensively when ironing the sintered body 1. Another reason for that is because when ironing the sintered body 1, the wall thickness portion on the surface layer of the sintered body 1 at the stepwise portions and protrusions will plastically deform in the direction along which the upper and lower punches 6, 5 move, which will then make it easy for burrs to occur.

Further, since the upper taper portions 15, 25 are made of materials having Young's moduli that are at least 50 GPa higher than that of the sintered body 1, the sintered body 1 can be densified with a small ironing margin S. Furthermore, the sintered body 1 is ironed without being compressed, by the high Young's modulus upper taper portions 15, 25 of the die upper portion 13 and the core rod upper portion 23, thus making it possible to prevent the breakage of the die member. In addition, the die can be restricted from being abraded due to ironing, since the upper taper portions 15, 25 of the die upper portion 13 and the core rod upper portion 23 are made of high hardness materials exhibiting high Young's moduli.

Moreover, die breakage due to compression can be restricted, since the straight portions 11, 21 of the die lower portion 14 and the core rod lower portion 24 are made of high-toughness materials exhibiting low Young's moduli.

Further, since the upper taper portions 15, 25 as the ironing portions and the lower straight portions 11, 21 as the compression portions are provided in a mutually divided manner, a part of the die that has been abraded may be replaced individually, thus making it possible to restrict die cost.

Furthermore, the reason that the sintered body 1 is to be compressed by the straight portions 11, 21 of the die lower portion 14 and the core rod lower portion 24 is because surface densification will not be sufficiently achieved if performing ironing alone.

In addition, the sintered body 1 can be prevented from forming burrs, since the die upper portion 13 and the core rod upper portion 23 are formed into sizes at which the sintered body 1, when ejected, will not come into contact with the same. In this embodiment, the sintered body 1, when ejected, will not come into contact with the die upper portion 13 and the core rod upper portion 23, when the smallest diameter NK of the lower end 15K of the die upper taper portion 15 is larger than the expanded outer diameter of the sintered body 1 that has come out of the straight portions 11, 21, and the largest diameter GK of the lower end 25K of the core upper taper portion 25 is smaller than the shrunk inner diameter of the sintered body 1 that has come out of the straight portions 11, 21. The outer and inner diameters of the sintered body 1 ejected expand and shrink due to the spring-back effect. However, the sintered body 1, when ejected, may come into contact with the lower taper portions 16, 26 of the die lower portion 14 and the core rod lower portion 24. In general, although materials having high Young's moduli and high hardnesses have low toughnesses and will easily cause the die to break and/or chip, they have resistance to abrasion. Also, although materials having low Young's moduli and high toughnesses have low harnesses and will easily cause the die to be abraded in general, they have resistance to breakage. Moreover, when the ironing margin S is large, the sintered body 1 will easily form burrs, and the die will easily break, in general.

Here, as is the case in the present embodiment, since the taper portions 12, 22 are composed of the upper taper portions 15, 25 having high Young's moduli; and the lower taper portions 16, 26 that are continuous to the upper taper portions 15, 25 and have low Young's moduli, the sintered body 1 may or may not be ironed at the lower taper portions 16, 26. The reason for that is as follows. That is, the die materials of the die lower portion 14 and the core rod lower portion 24 have Young's moduli smaller than those of the die materials of the die upper portion 13 and the core rod upper portion 23. Therefore, the sintered body 1 that has been ironed by the upper taper portions 15, 25 will plastically deform in a fashion such that the dimension of the sintered body 1 in the outer diameter direction will shrink and the dimension thereof in the inner diameter direction will expand. There, at the die lower portion 14 and the core rod lower portion 24, the sintered body 1, the die lower portion 14 and the core rod lower portion 24 will merely undergo elastic deformation in a mutual manner, and the sintered body 1 will not be ironed, at least when the die lower portion 14 and the core rod lower portion 24 as lower dies have dimensions identical to those of the lower ends 15K, 25K of the upper taper portions 15, 25 (i.e. as is the case shown in FIG. 10 where a tapered section is not provided at the lower taper portion, but the straight portions 11, 21 are formed immediately therebelow). Here, the reason that the lower taper portions 16, 26 are provided at the die lower portion 14 and the core rod lower portion 24 is as follows. That is, the sintered body 1 is to be elastically deformed as much as possible at the lower taper portions 16, 26 before being compressed by the upper and lower punches 6, 5. By the time that the sintered body 1 has reached the straight portions 11, 21, the sintered body 1 will have been elastically deformed to the extent that it is almost plastically deformed or has already been slightly plastically deformed. In this way, the outer diameter of the sintered body 1 that has been ironed by the upper taper portions 15, 25 will not expand, and the inner diameter thereof will not shrink, when later using the upper and lower punches 6, 5 to compress the above sintered body 1 that it is almost plastically deformed or has already been slightly plastically deformed, and thus eliminate the surface voids through plastic deformation. In other words, when the die lower portion 14 and the core rod lower portion 24 have no tapered sections, and share identical diameters with the lower ends 15K, 25K of the upper taper portions 15, 25, the die lower portion 14 and the core rod lower portion 24 will exhibit Young's moduli that are smaller than those of the die upper portion 13 and the core rod upper portion 23 when performing compression, which may then cause the outer diameter of the sintered body 1 to expand and the inner diameter thereof to shrink at the taper portions 12, 22.

Further, the sintered body 1 will again have to be ironed by the upper taper portions 15, 25, if the outer diameter thereof expands and the inner diameter thereof shrinks due to the spring-back effect observed at the time of ejecting the sintered body 1 from the die. In this sense, the upper taper portions 15, 25 may break and/or be abraded intensely; and the sintered body 1 may form burrs more easily. In order to avoid these problems, it is preferred that the lower taper portions 16, 26 be provided.

In addition, it is preferred that an ironing margin S' of the lower taper portions 16, 26 be determined around the time when the sintered body 1 that has been ironed by the upper taper portions 15, 25 starts to deform plastically. When the sintered body 1 has been overly plastically deformed by the lower taper portions 16, 26, burrs will occur; and when the sintered body 1 is elastically deformed in an extremely insufficient manner, it will come into contact with the die upper portion 13 and the core rod upper portion 23 when ejected, thus causing the die upper portion 13 and the core rod upper portion 23 to break and/or be abraded intensely, and making it easier for the sintered body 1 to form burrs. As shown in FIG. 2B, the ironing margin S' of the lower taper portions 16, 26 is the difference between radius dimensions at the upper and lower ends of the lower taper portions 16, 26.

In order to prevent the sintered body 1 ejected from coming into contact with the upper taper portions 15, 25, the ironing margin S' of the lower taper portions 16, 26 needs to be large, and the dimension of the sintered body 1 in the radial direction may be reduced to the extent that when ejecting the sintered body 1 that has been ironed by the lower taper portions 16, 26 and thus plastically deformed, the sintered body 1 will not come into contact with the die upper portion 13 and the core rod upper portion 23. In this case, the dimensions of the die 3 and the core rod 4 may be determined based on, for example, the material and size of the sintered body 1, and a force applied thereto when compressing the same.

Tests were performed using the sizing dies 2 of the first embodiment, as examples of the present invention; and using dies of comparative examples.

TABLE 1

| | Ironing margin (mm) | Young's modulus of upper portion (GPa) | Young's modulus of lower portion (GPa) | Young's modulus of sintered body (GPa) | Burr | Densification | Evaluation |
|---|---|---|---|---|---|---|---|
| Invention example 1 | 0.1 | 220 | 210 | 170 | Not observed | Densified | ○ |
| Invention example 2 | 0.2 | 220 | 210 | 170 | Observed | Densified | Δ |
| Invention example 3 | 0.1 | 550 | 210 | 170 | Not observed | Densified | ○ |
| Invention example 4 | 0.2 | 550 | 210 | 170 | Observed | Densified | Δ |
| Invention example 5 | 0.1 | 550 | 210 | 200 | Not observed | Densified | ○ |
| Invention example 6 | 0.2 | 550 | 210 | 200 | Observed | Densified | Δ |
| Comparative example 1 | 0.1 | 220 | 210 | 200 | Not observed | Not densified | x |
| Comparative example 2 | 0.2 | 220 | 210 | 200 | Not observed | Not densified | x |

In Table 1, "Young's modulus of upper portion" refers to the Young's modulus of the die upper portion 13 and core rod upper portion 23; and "Young's modulus of lower portion" refers to the Young's modulus of the die lower portion 14 and core rod lower portion 24. Further, tests were performed with various ironing margins S, Young's moduli of the die upper portion, and Young's moduli of the sintered body 1.

Particularly, the approach angle θ was set to be 5° in all cases, and the compression pressure provided by the upper and lower punches 6, 5 at the straight portions 11, 21 was set to be 10 t/cm$^2$. Further, the sintered body 1 used was a ferrous sintered body and had a relative density of 94%. In addition, evaluation was made on whether the sized sintered body 1 had been densified, and it was conducted by evaluating whether a 0 to 0.3 mm surface relative density had reached 97%. The presence of burrs was evaluated based on the presence of burrs of a size of not smaller than 0.5 mm. As for the evaluation results, examples exhibiting burrs but densified are marked "Δ," examples exhibiting no burrs and densified are marked "○," and examples exhibiting no burrs but not densified are marked "x" in Table 1.

Based on the above results, it became clear that surface densification took place when the Young's modulus of the die upper portion 13 and core rod upper portion 23 was at least 50 GPa higher than that of the unsized sintered body 1. Further, burrs could be prevented when the ironing margin S was not larger than 0.1 mm

TABLE 2

| | Ironing margin (mm) | Young's modulus of upper portion (GPa) | Young's modulus of lower portion (GPa) | Young's modulus of sintered body (GPa) | Approach angle (°) | Burr | Densification | Evaluation |
|---|---|---|---|---|---|---|---|---|
| Invention example 7 | 0.1 | 220 | 210 | 170 | 5 | Not observed | Densified | ○ |
| Invention example 8 | 0.1 | 220 | 210 | 170 | 10 | Observed | Densified | Δ |
| Invention example 9 | 0.1 | 550 | 210 | 200 | 10 | Observed | Densified | Δ |
| Comparative example 3 | 0.1 | 220 | 210 | 200 | 10 | Not observed | Not densified | x |

Based on the above results, it became clear that burrs could be prevented when the approach angle θ was smaller than 10°. Further, it also became clear that even when the approach angle θ was larger, surface densification would not take place unless the Young's modulus of the die upper portion 13 and core rod upper portion 23 was at least 50 GPa higher than that of the unsized sintered body 1. Also, the reason that certain examples exhibiting burrs are marked "Δ" is because the burrs can simply be removed through a post-process, and there shall not be incurred any critical problem as a product, even though cost will rise since a process for removing the burrs is now required.

As is the case with the present embodiment and in connection with claim 1, provided is a die for sizing the sintered body 1 obtained by sintering a compact of a metal powder, by compressing the same at the straight portions 11, 21. The upper taper portions 15, 25 as taper portions are provided at the die upper portion 13 and core rod upper portion 23 as the upper portions of the die member, and the straight portions 11, 21 are provided at the die lower portion 14 and core rod lower portion 24 as the lower portions of the die member. The materials of the die upper portion 13 and core rod upper portion 23 have Young's moduli higher than those of the materials of the die lower portion 14 and the core rod lower portion 24. The die upper portion 13 and core rod upper portion 23 are made of materials having Young's moduli that are at least 50 GPa higher than that of the sintered body 1. For these reasons, the sintered body 1 can be densified with a smaller ironing margin S. Further, since the sintered body 1 is ironed without being compressed at the taper portions of the die upper portion 13 and core rod upper portion 23 that are made of materials having high Young's moduli, not only die breakage can be prevented, but the die can be restricted from being abraded due to ironing.

Meanwhile, the reason that the sintered body 1 is to be compressed at the die lower portion 14 and the core rod lower portion 24 is because ironing alone cannot realize sufficient surface densification. Further, the die lower portion 14 and the core rod lower portion 24 are made of high-toughness materials that are different from the materials of the die upper portion 13 and the core rod upper portion 23, and have Young's moduli lower than those of the die upper portion 13 and the core rod upper portion 23, thereby making it possible to restrict die breakage occurring due to compression at the straight portions 11, 21.

Further, as is the case with the present embodiment and in connection with claim 2, since the die member includes the die 3, the die 3 can be prevented from being abraded and damaged when sizing the sintered body 1 and densifying the surface thereof at the same time.

Furthermore, as is the case with the present embodiment and in connection with claim 3, since the die member includes the core rod 4, the core rod 4 can be prevented from being abraded and damaged when sizing the sintered body 1 and densifying the surface thereof at the same time.

Furthermore, as is the case with the present embodiment and in connection with claim 4, at the die lower portion 14 and the core rod lower portion 24, the lower taper portions 16, 26 are provided between the straight portions 11, 21 and the upper taper portions 15, 25 as the taper portions of the die upper portion 13 and the core rod upper portion 23. Therefore, the sintered body 1 that has been ironed by the upper taper portions 15, 25 of the die upper portion 13 and the core rod upper portion 23 will undergo plastic deformation to be reduced size, since the Young's moduli of the materials of the die lower portion 14 and the core rod lower portion 24 are lower than those of the materials of the die upper portion 13 and the core rod upper portion 23. Next, the die lower portion 14, the core rod lower portion 24 and the sintered body 1 will mutually undergo elastic deformation at the lower taper portions 16, 26 of the die lower portion 14 and the core rod lower portion 24. The effects of providing the lower taper portions 16, 26 at the die lower portion 14 and the core rod lower portion 24 are as follows. That is, the sintered body 1 is to be elastically deformed as much as possible before being compressed at the straight portions 11, 21. By the time that the sintered body 1 has reached the straight portions 11, 21, the sintered body 1 will have been elastically deformed to the extent that it is almost plastically deformed or has already been slightly plastically deformed. In this way, the outer diameter of the sintered body 1 that has been ironed by the upper taper portions 15, 25 of the die upper portion 13 and the core rod upper portion 23 will not expand, and the inner diameter thereof will not shrink, when later compressing the above sintered body 1 that it is almost plastically deformed or has already been slightly plastically deformed to eliminate the surface voids thereof through plastic deformation. Particularly, when the die lower portion 14 and the core rod lower portion 24 have no lower taper portions 16, 26, and have constant diameters, the die lower portion 14 and the core rod lower portion 24 will exhibit Young's moduli that are smaller than those of the die upper portion 13 and the core rod upper portion 23 when performing compression, which may then cause the outer diameter of the sintered body 1 to expand and the inner diameter thereof to shrink. Further, the sintered body 1 will again have to be ironed by coming into contact with the die upper portion 13 and the core rod upper portion 23, if the outer diameter thereof expands and the inner diameter thereof shrinks when ejected. In this sense, the die upper portion 13 and the core rod upper portion 23 may break and/or be abraded intensely; and the sintered body 1 may form burrs more easily. These problems can be avoided by providing the lower taper portions 16, 26 at the die lower portion 14 and the core rod lower portion 24.

Furthermore, as is the case with the present embodiment and in connection with claim 5, at the die lower portion 14 as the lower portion of the die 3, the die lower taper portion 16 is provided between the die straight portion 11 and the upper taper portion 15 as the taper portion of the die upper portion 13 as the upper portion of the die 3, thereby making it possible to prevent the die upper portion 13 from breaking and being abraded intensely, and the sintered body 1 from forming burrs.

Furthermore, as is the case with the present embodiment and in connection with claim 6, at the core rod lower portion 24 as the lower portion of the core rod 4, the core lower taper portion 26 is provided between the core straight portion 21 and the upper taper portion 25 as the taper portion of the core rod upper portion 23 as the upper portion of the core rod 4, thereby making it possible to prevent the core rod upper portion 23 from breaking and being abraded intensely, and the sintered body 1 from forming burrs.

Furthermore, as is the case with the present embodiment and in connection with claim 7, since the die upper portion 13 and/or core rod upper portion 23 as the upper portions of the die member are formed into sizes with which the sintered body 1 will not come into contact when ejected, the sintered body 1, when ejected, will not come into contact with the die upper portion 13 and/or core rod upper portion 23, thereby making it possible to prevent the sintered body 1 from forming burrs when ejected.

Furthermore, as is the case with the present embodiment and in connection with claim 8, since the die upper portion 13 as the upper portion of the die 3 is formed into a size larger than an expanded size of the sintered body 1 that has expanded due to an outer diameter spring-back effect when ejected, the sintered body 1, when ejected, will not come into contact with the die upper portion 13, thereby making it possible to prevent the sintered body 1 from forming burrs when ejected.

Furthermore, as is the case with the present embodiment and in connection with claim 9, since the core rod upper portion 23 as the upper portion of the core rod 4 is formed into a size smaller than a shrunk size of the sintered body 1 that has shrunk due to an inner diameter spring-back effect when ejected, the sintered body 1, when ejected, will not come into contact with the core rod upper portion 23, thereby making it possible to prevent the sintered body 1 from forming burrs when ejected.

Furthermore, as is the case with the present embodiment and in connection with claim 10, since the die upper portion 13 and core rod upper portion 23 as the upper portions of the die member are made of materials having Young's moduli of not lower than 300 GPa, and the die lower portion 14 and core rod lower portion 24 as the lower portions of the die member are made of materials having Young's moduli of lower than 300 GPa, the die upper portion 13 and the core rod upper portion 23 can be prevented from breaking and being abraded intensely, and the sintered body 1 can be prevented from forming burrs.

Furthermore, as is the case with the present embodiment and in connection with claim 11, since the die upper portion 13 and core rod upper portion 23 as the upper portions of the die member are made of cemented carbides, and the die lower portion 14 and core rod lower portion 24 as the lower portions of the die member are made of ferrous tool steels, the die upper portion 13 and the core rod upper portion 23 can be prevented from breaking and being abraded intensely, and the sintered body 1 can be prevented from forming burrs.

Furthermore, as is the case with the present embodiment and in connection with claim 12, since the ironing margin S of the sintered body 1 is not larger than 0.1 mm based on the die upper portion 13 and core rod upper portion 23 as the upper portions of the die member, the sized sintered body 1 can be prevented from forming burrs, and the abrasion of the upper portions of the die member can be restricted.

Furthermore, as is the case with the present embodiment and in connection with claim 13, since the approach angle θ of the upper taper portions 15, 25 of the die upper portion 13 and core rod upper portion 23 as the upper portions of the die member is smaller than 10°, the sized sintered body 1 can be prevented from forming burrs, and the abrasion of the die upper portion 13 and the core rod upper portion 23 can be restricted.

Furthermore, as is the case with the present embodiment and in connection with claim 14, since provided is a production method capable of sizing the sintered body 1 and densifying the surface thereof at the same time using the sizing die 2 as set forth in any one of claims 1 to 6, there can be obtained the sintered body 1 having a densified surface.

Furthermore, as is the case with the present embodiment and in connection with claim 15, the production method capable of sizing the sintered body 1 and densifying the surface thereof at the same time is such that the sintered body 1 is to be sized by the upper taper portions 15, 25 when inserted from the upper taper portions 15, 25 of the die upper portion 13 and core rod upper portion 23 as the upper portions of the die member toward the straight portions 11, 21 of the die lower portion 14 and core rod lower portion 24 as the lower portions of the die member, and that the sintered body 1 is vertically compressed by the punches 5, 6 at the straight portions 11, 21 of the die lower portion 14 and the core rod lower portion 24. Thus, there can be obtained the sintered body 1 having a densified surface.

Furthermore, as is the case with the present embodiment and in connection with claim 16, since the unsized sintered body 1 has a Young's modulus of not lower than 200 GPa, the sintered body 1 having a Young's modulus of not lower than 200 GPa can have its surface densified.

Furthermore, as is the case with the present embodiment and in connection with claim 17, since the production method provided does not require processing the sintered body 1 that has been sized, and burrs formation at the time of performing sizing can still be restricted, there is no need to remove burrs.

Furthermore, as is the case with the present embodiment and in connection with claim 18, provided is a product produced by the production method as set forth in any one of claims 14 to 16, and the product obtained is made of the sintered body 1 having a densified surface.

In addition, one effect of the present embodiment is that the die upper portion 13 and the core rod upper portion 23 can be detachably provided on the die lower portion 14 and the core rod lower portion 24 through a fixation unit such as a screw (not shown). In such case, the die upper portion 13 and the core rod upper portion 23 can be replaced easily. Further, since the die lower portion 14 and the core rod lower portion 24 are made of materials having Young's moduli higher than that of the sintered body 1, and exhibit 0.2% proof stresses larger than that of the sintered body 1, sizing at the straight portions 11, 21 can be performed reliably. Particularly, as described above, it is preferred that the die upper portion 13 and the core rod upper portion 23 be made of materials having Young's moduli that are at least 50 GPa higher than that of the unsized sintered body 1, and that the die lower portion 14 and the core rod lower portion 24 be made of materials having Young's moduli that are at least 30 GPa higher than that of the unsized sintered body 1.

Second Embodiment

Figure 6:
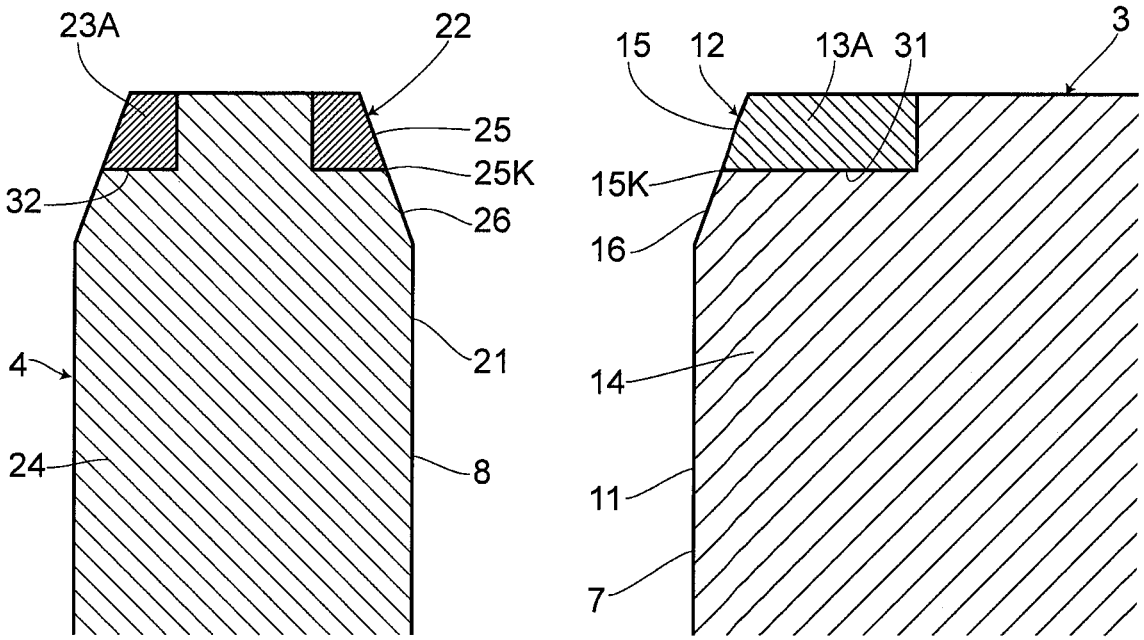
FIG. 6 is a cross-sectional view of a die described in a second embodiment of the invention.

FIG. 6 shows a second embodiment of the present invention. Parts identical to those in the first embodiment are given identical symbols, and the descriptions thereof are thus omitted. In this embodiment, formed on the upper region of the die lower taper portion 16 of the die lower portion 14 is a concave portion 31 having the shape of a ring in the planar view. Further, fixed to such concave portion 31 is a ring-shaped die upper portion 13A having the die upper taper portion 15. Further, a concave portion 32 having the shape of a ring in the planar view is formed on the upper region of the core lower taper portion 26 of the core rod lower portion 24, and fixed to such concave portion 32 is a ring-shaped core rod upper portion 23A having the core upper taper portion 25.

In this way, there can be restricted the cost of the die upper portion 13 and core rod upper portion 23 that have higher Young's moduli.

That is, the present embodiment brings about functions and effects that are similar to those of the first embodiment.

Further, in this embodiment, the die upper portion 13A having the die upper taper portion 15 is formed into the shape of a ring; the die upper portion 13A is provided on the concave portion 31 of the die lower portion 14; the core rod upper portion 23A having the core upper taper portion 25 is formed into the shape of a ring; and the core rod upper portion 23A is provided on the concave portion 32 of the core rod lower portion 24. Thus, the material cost of the die upper portion 13A and the core rod upper portion 23A can be reduced.

Third Embodiment

Figure 7:
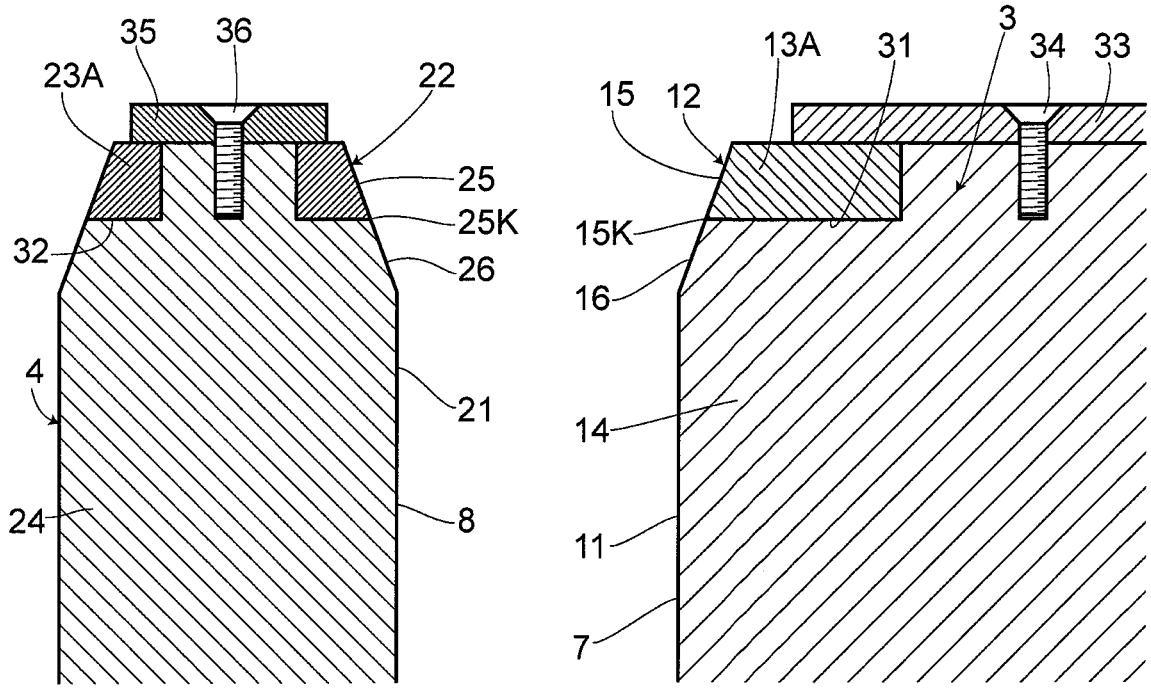
FIG. 7 is a cross-sectional view of a die described in a third embodiment of the invention.

FIG. 7 shows a third embodiment of the present invention. Parts identical to those in the aforementioned embodiments are given identical symbols, and the descriptions thereof are thus omitted. In this embodiment and in connection with the second embodiment, the die upper portion 13 and the core rod upper portion 23 are provided in a manner such that they can be replaced through a replacement tool.

Specifically, a ring-shaped die holder 33 is used. With the lower surface of such die holder 33 being in contact with the upper surface of the die upper portion 13, a screw 34 as a fixation member is used to fix the die holder 33 to the upper surface of the die lower portion 14. In this way, the die upper portion 13 is allowed to be fixed to the die lower portion 14, and the die upper portion 13 can be replaced by unscrewing the screw.

Further, a ring-shaped core rod holder 35 is used. With the lower surface of such core rod holder 35 being in contact with the upper surface of the core rod upper portion 23, a screw 35 as a fixation member is used to fix the cord rod holder 35 to the upper surface of the core rod lower portion 24. In this way, the core rod upper portion 23 is allowed to be fixed to the core rod lower portion 24, and the core rod upper portion 23 can be replaced by unscrewing the screw 36.

In this way, the present embodiment brings about functions and effects that are similar to those of the abovementioned embodiments.

Further, since this embodiment employs the holders 33, 35 as replacement tools for detachably fixing the die upper portion 13 and the core rod upper portion 23 to the die lower portion 14 and the core rod lower portion 24, respectively, the die upper portion 13 and the core rod upper portion 23 can be replaced easily.

Fourth Embodiment

Figure 8:
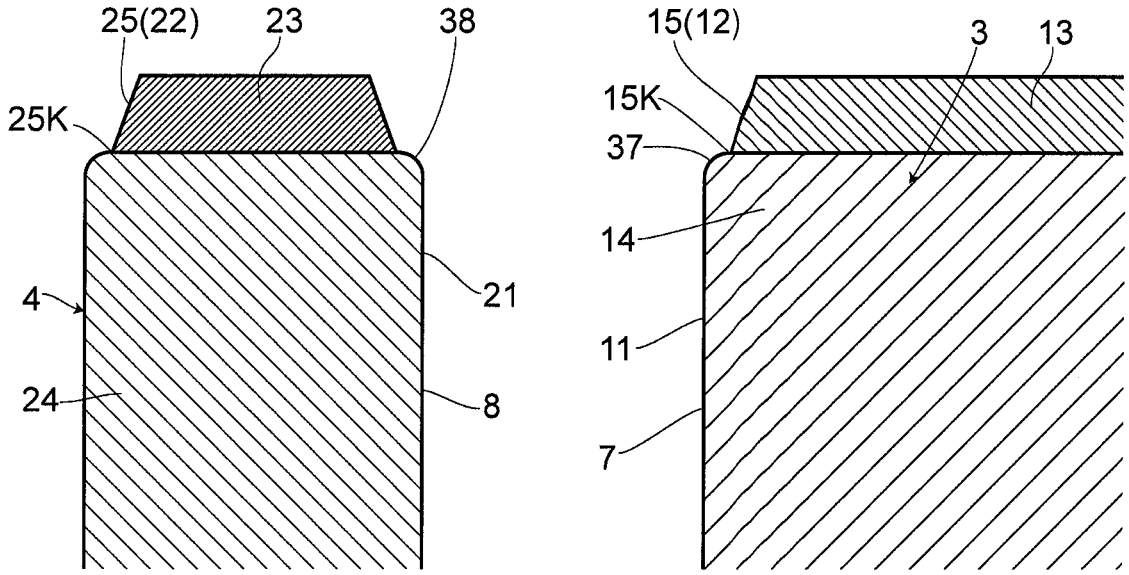
FIG. 8 is a cross-sectional view of a die described in a fourth embodiment of the invention.

FIG. 8 shows a fourth embodiment of the present invention. Parts identical to those in the aforementioned embodiments are given identical symbols, and the descriptions thereof are thus omitted. In this embodiment, the die lower taper portion 16 is not provided, and provided between the die upper taper portion 15 and the die straight portion 11 is a curved portion 37 formed by round chamfering the upper corner region of the inner circumference of the die lower portion 14. The inner diameter at the die straight portion 11 is smaller than the inner diameter at the lower end 15K of the die upper taper portion 15. Here, the curved portion 37 is curved starting from the lower end 15K.

Further, the core lower taper portion 26 is not provided, and provided between the core upper taper portion 25 and the core straight portion 21 is a curved portion 38 formed by round chamfering the upper corner region of the inner circumference of the core rod lower portion 24. The inner diameter at the core straight portion 21 is larger than the inner diameter at the lower end 25K of the core upper taper portion 25. Here, the curved portion 38 is curved starting from the lower end 25K. Particularly, in this embodiment, the curved portions 37, 38 serve as intermediate portions.

In this way, in the present embodiment, the sintered body 1 and the curved portions 37, 38 as the intermediate portions will merely undergo elastic deformation in a mutual manner without having the sintered body 1 ironed, at the curved portions 37, 38 of the die lower portion 14 and the core rod lower portion 24. Thus, this embodiment brings about functions and effects that are similar to those of the abovementioned embodiments.

Fifth Embodiment

Figure 9:
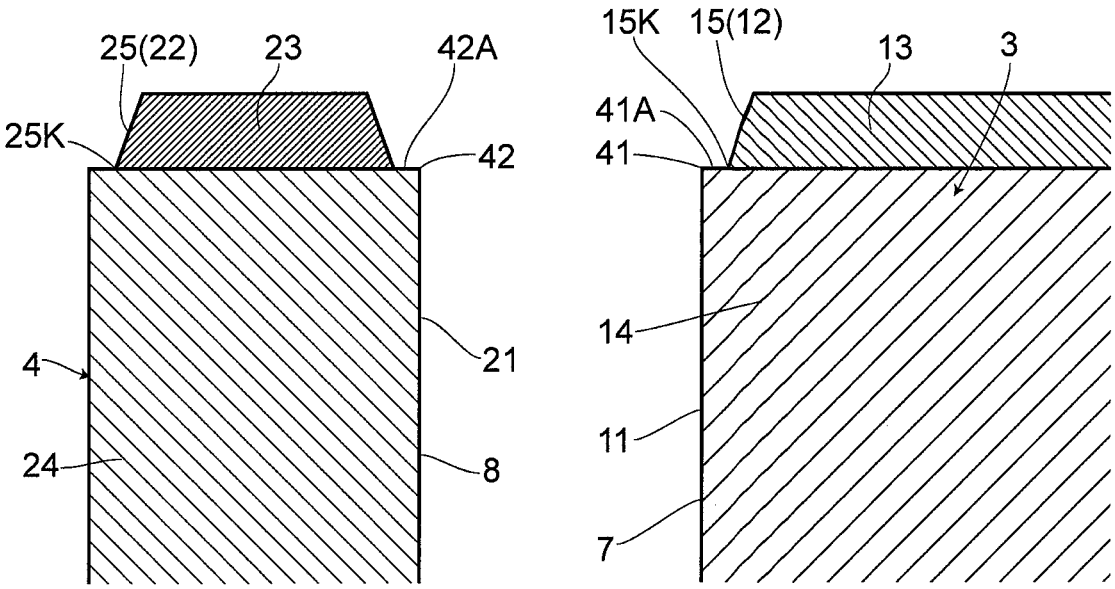
FIG. 9 is a cross-sectional view of a die described in a fifth embodiment of the invention.

FIG. 9 shows a fifth embodiment of the present invention. Parts identical to those in the aforementioned embodiments are given identical symbols, and the descriptions thereof are thus omitted. In this embodiment, the die lower taper portion 16 is not provided at the die 3, but an inner circumference upper end corner portion 41 is provided at the die lower portion 14. An upper surface 41A of this inner circumference upper end corner portion 41 is formed in the left-right direction.

Further, the core lower taper portion 26 is not provided at the core rod 4, but an outer circumference upper end corner portion 42 is provided at the core rod lower portion 24. An upper surface 42A of this outer circumference upper end corner portion 42 is formed in the left-right direction. Particularly, in this example, the inner circumference upper end corner portion 41 and the outer circumference upper end corner portion 42 serve as intermediate portions.

In this way, in the present embodiment, the sintered body 1 and the inner and outer circumference upper end corner portions 41, 42 as the intermediate portions will merely undergo elastic deformation in a mutual manner without having the sintered body 1 ironed, at the curved portions 37, 38 of the die lower portion 14 and the core rod lower portion 24. Thus, this embodiment brings about functions and effects that are similar to those of the abovementioned embodiments.

Sixth Embodiment

Figure 10:
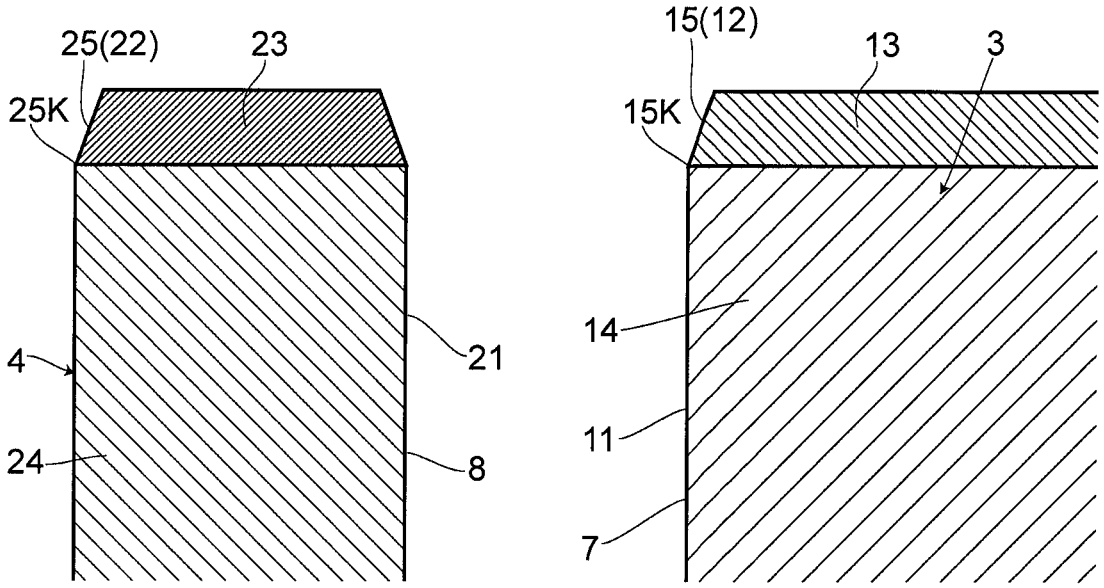
FIG. 10 is a cross-sectional view of a die described in a sixth embodiment of the invention.

FIG. 10 shows a sixth embodiment of the present invention. Parts identical to those in the aforementioned embodiments are given identical symbols, and the descriptions thereof are thus omitted. In this embodiment, the lower taper portions 16, 26 are not provided, but the entire taper portions 12, 22 are provided at the die upper portion 13 and the core rod upper portion 23. That is, the taper portions 12, 22 are composed of the upper taper portions 15, 25, and the diameter at the lower end 25K of the upper taper portions 15, 25 is identical to the diameter at the straight portions 11, 21.

Thus, this embodiment brings about functions and effects that are similar to those of the abovementioned embodiments.

Seventh Embodiment

Figure 11:
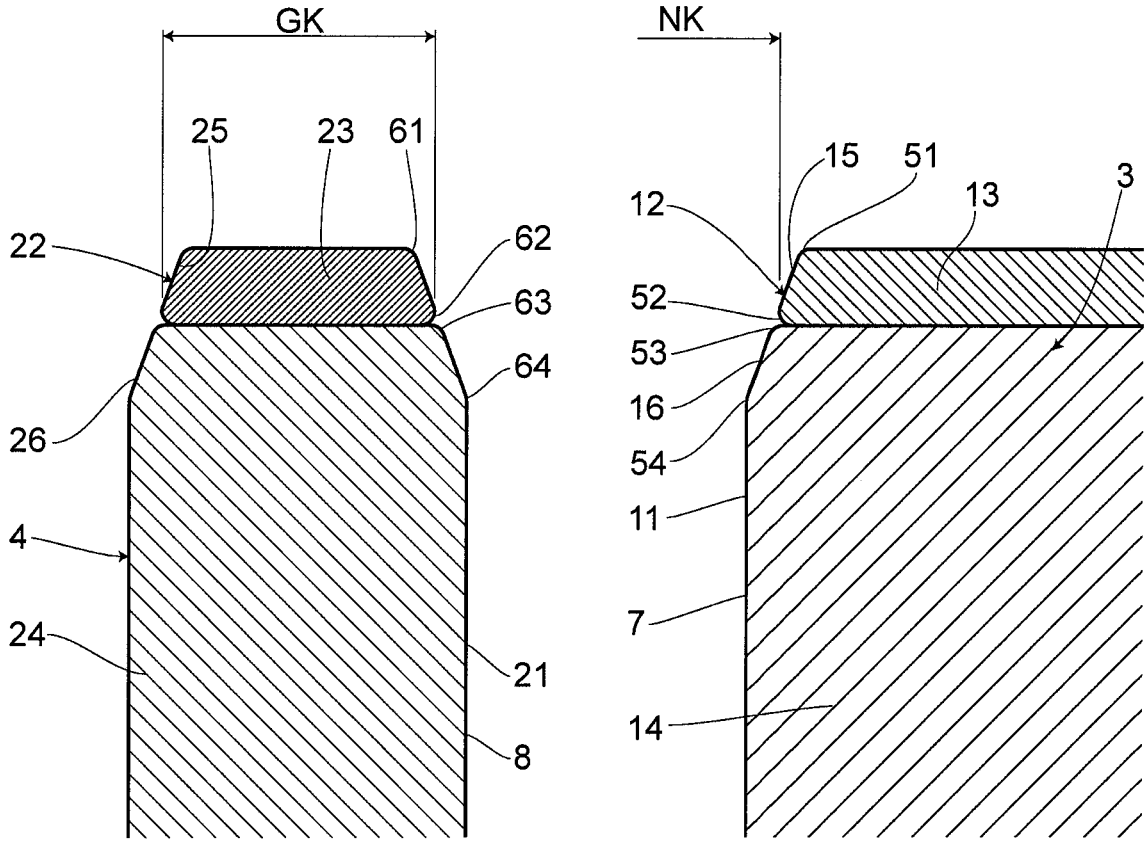
FIG. 11 is a cross-sectional view of a die described in a seventh embodiment of the invention.

FIG. 11 shows a seventh embodiment of the present invention. Parts identical to those in the aforementioned embodiments are given identical symbols, and the descriptions thereof are thus omitted. In this embodiment, a curved portion 51 is formed by round chamfering the inner circumference upper corner portion of the die upper portion 13, and a curved portion 52 is formed by round chamfering the inner circumference lower corner portion (lower end 15K) of the die upper portion 13. In addition, a curved portion 53 is formed by round chamfering the inner circumference upper corner portion of the die upper taper portion 16 of the die lower portion 14, and a curved portion 54 is formed by round chamfering the inner circumference lower corner portion of the die lower taper portion 16 of the die lower portion 14. That is, the curved portion 53 is provided between the upper surface of the die lower portion 14 and the die lower taper portion 16, and the curved portion 54 is provided between the die lower taper portion 16 and the straight portion 11.

Further, a curved portion 61 is formed by round chamfering the outer circumference upper corner portion of the core rod upper portion 23, and a curved portion 62 is formed by round chamfering the outer circumference lower corner portion (lower end 25K) of the core rod upper portion 23. In addition, a curved portion 63 is formed by round chamfering the outer circumference upper corner portion of the core lower taper portion 26 of the core rod lower portion 24, and a curved portion 64 is formed by round chamfering the outer circumference lower corner portion of the core lower taper portion 26 of the core rod lower portion 24. That is, the curved portion 63 is provided between the upper surface of the core rod lower portion 24 and the core lower taper portion 26, and the curved portion 64 is provided between the core lower taper portion 26 and the straight portion 21.

Also, in this embodiment, the smallest diameter NK of the die upper portion 13 constitutes the smallest diameter of the curved portion 52 provided at the lower end, and the largest diameter GK of the core rod upper portion 23 constitutes the largest diameter of the curved portion 52 provided at the lower end.

Particularly, in this embodiment, the ironing margin S at the die upper portion 13 is one-half of the difference between the outer diameter dimension of the sintered body 1 and the inner diameter dimension (smallest diameter NK) of the curved portion 52 formed at the lower region of the upper taper portion 15. Further, the ironing margin S at core rod upper portion 23 is one-half of the difference between the inner diameter dimension of the sintered body 1 and the outer diameter dimension (largest diameter GK) of the curved portion 62 formed at the lower region of the upper taper portion 25.

In this way, this embodiment brings about functions and effects that are similar to those of the abovementioned embodiments. The sintered body 1, when ejected, can be prevented from coming into contact with the die upper portion 13 and the core rod upper portion 23.

Particularly, in this embodiment, when there is a possibility that the sintered body 1 may collide with the die upper portion 13 and the core rod upper portion 23 when ejected, due to the spring-back effect, the curved portions 52, 62 provided can then prevent the die upper portion 13 and the core rod upper portion 23 from breaking. Moreover, since there are provided the curved portions 52, 53, 54, 62, 63 and 64, the sintered body 1 can be smoothly pushed in and taken out.

However, the present invention is not limited to the aforementioned embodiments, and various modified embodiments are possible. For example, although the approach angles of the upper and lower taper portions are identical to each other in the above embodiments, it may also be configured in a way such that the approach angle of the upper taper portion is not larger than 10° so that the approach angles of the upper and lower taper portions will differ from each other. Further, although both the die upper portion and the core rod upper portion in the above embodiments are made of materials having Young's moduli higher than those of the materials of the die lower portion and the core rod lower portion, one of the die upper portion and the core rod upper portion may be made of a material having a Young's modulus higher than the material of one of the die lower portion and the core rod lower portion. In such case, the other of the die upper portion and the core rod upper portion is to be integrally formed along with the other of the die lower portion and the core rod lower portion i.e. they are to be formed with an identical material. At that time, it is preferred that a taper portion also be provided on the other of the die and the core rod, and the approach angle at such taper portion is also set to be smaller than 10°. In addition, although the seventh embodiment shown in FIG. 11 is an embodiment in which the curved portions 51, 52, 53, 54, 61, 62, 63 and 64 are provided on the die of the first embodiment, these curved portions 51, 52, 53, 54, 61, 62, 63 and 64 may also be provided on the dies of the second embodiment through the sixth embodiment. With regard to the sixth embodiment shown in FIG. 10, the curved portions 37, 38 may be provided on the die lower portion and the core rod lower portion. Further, although cemented carbides are listed as the examples of materials having high Young's moduli, this is simply because cemented carbides are relatively low-cost at this time and have a certain level of toughness. Without any regard to cost or the like, there may also be used materials with Young's moduli higher than those of cemented carbides, such as aggregated diamond nanorod, lonsdaleite, diamond, diamond sintered body, heterodiamond, superhard phase composed of single-wall carbon nanotubes, and c-BN. In addition, whenever a material having a Young's modulus higher than those of cemented carbides, a relatively low cost and a certain level of toughness has been invented through technological innovation, that material may also be used.

DESCRIPTION OF SYMBOLS

1 Sintered body
2 Sizing die
3 Die (die member)
4 Core rod (die member)
5 Lower punch
6 Upper punch
11 Die straight portion
12 Die taper portion
13, 13A Die upper portion (upper portion of die member)
14 Die lower portion (lower portion of die member)
15 Die upper taper portion
16 Die lower taper portion
21 Core straight portion
22 Core taper portion
23, 23A Core rod upper portion (upper portion of die member)
24 Core rod lower portion (lower portion of die member)
25 Core upper taper portion
26 Core lower taper portion
23A Core rod upper portion
S Ironing margin

The invention claimed is:

1. A sizing die for densifying a sintered body surface, comprising:

a die member having;

a taper portion provided on an upper portion of said die member, and a straight portion provided on a lower portion of said die member, said straight portion adapted to compress and size a sintered body obtained by sintering a compact of a metal powder therein, wherein said upper portion of said die member is made of a material having a Young's modulus that is higher than the Young's modulus of a material of said lower portion of said die member, and is at least 50 GPa higher than the Young's modulus of said sintered body which the die is adapted to form, and said sintered body has a Young's modulus in a range of 170 GPa or more before said sintered body is sized.

2. The sizing die for densifying a sintered body surface according to claim 1, wherein said die member includes a die.

3. The sizing die for densifying a sintered body surface according to claim 2, wherein at a lower portion of said die, a lower taper portion is provided between said straight portion and a taper portion of an upper portion of said die.

4. The sizing die for densifying a sintered body surface according to claim 3, wherein an upper portion of said die is formed into a size larger than an expanded size of said sintered body that has expanded due to an outer diameter spring-back effect when ejected.

5. The sizing die for densifying a sintered body surface according to claim 1, wherein said die member includes a core rod.

6. The sizing die for densifying a sintered body surface according to claim 5, wherein at a lower portion of said core rod, a lower taper portion is provided between said straight portion and a taper portion of an upper portion of said core rod.

7. The sizing die for densifying a sintered body surface according to claim 6, wherein the upper portion of said core rod is formed into a size smaller than a shrunk size of said sintered body that has shrunk due to an inner diameter spring-back effect when ejected.

8. The sizing die for densifying a sintered body surface according to claim 1, wherein at said lower portion of said die member, a lower taper portion is provided between said straight portion and said taper portion of said upper portion of said die member.

9. The sizing die for densifying a sintered body surface according to claim 8, wherein said upper portion of said die member is formed into a size such that said sintered body does not come into contact with the die member when ejected.

10. The sizing die for densifying a sintered body surface according to claim 1, wherein said upper portion of said die member is made of a material having a Young's modulus not smaller than 300 GPa, and said lower portion of said die member is made of a material having a Young's modulus smaller than 300 GPa.

11. The sizing die for densifying a sintered body surface according to claim 10, wherein said upper portion of said die member is made of a cemented carbide, and said lower portion of said die member is made of a ferrous tool steel.

12. The sizing die for densifying a sintered body surface according to claim 1, wherein an ironing margin of said sintered body is not larger than 0.1 mm based on said upper portion of said die member.

13. The sizing die for densifying a sintered body surface according to claim 1, wherein an approach angle of said taper portion of said upper portion of said die member is smaller than 10°.

14. A production method for sizing a sintered body comprising the step of sizing said sintered body and densifying a surface thereof at the same time while using the sizing die as set forth in claim 1.

15. The production method according to claim 14, wherein said sintered body is sized and has the surface thereof densified at the same time in a manner such that said sintered body is sized by said taper portion when inserted from said taper portion of said upper portion of said die member toward said straight portion of said lower portion of said die member, and is vertically compressed by punches at said straight portion of said lower portion of said die member.

16. The production method according to claim 14, wherein said sintered body is not further processed after being sized.

* * * * *